US006792916B2

(12) United States Patent
Oashi

(10) Patent No.: US 6,792,916 B2
(45) Date of Patent: Sep. 21, 2004

(54) CONTROL DEVICE OF COMMON RAIL FUEL INJECTION SYSTEM OF AN ENGINE

(75) Inventor: Yoshiro Oashi, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 75 days.

(21) Appl. No.: 10/232,336

(22) Filed: Aug. 30, 2002

(65) Prior Publication Data

US 2003/0062030 A1 Apr. 3, 2003

(30) Foreign Application Priority Data

Sep. 28, 2001 (JP) ..... 2001-301798

(51) Int. Cl.[7] ..... F02M 33/04
(52) U.S. Cl. ..... 123/446; 123/447; 123/511
(58) Field of Search ..... 123/510, 511, 123/446; 417/298

(56) References Cited

U.S. PATENT DOCUMENTS 6,209,522 B1 * 4/2001 Onishi et al. ..... 123/458
6,422,203 B1 * 7/2002 Djordjevic ..... 123/456

FOREIGN PATENT DOCUMENTS

| | | |
|---|---|---|
| DE | 197 57 594 A1 | 7/1999 |
| DE | 101 14 374 C1 | 6/2002 |
| EP | 1 065 372 A2 | 1/2001 |
| JP | 58-174773 | 10/1983 |
| JP | 62165083 | 7/1987 |
| JP | 11-336638 | 12/1999 |
| JP | 2001-003791 | 1/2001 |
| WO | WO 00/29742 | 5/2000 |

OTHER PUBLICATIONS

Copy of EPC Search Report for Ser. No. EP 02 01 9672 dated Jan. 7, 2004.

* cited by examiner

*Primary Examiner*—Thomas Moulis
(74) *Attorney, Agent, or Firm*—McCormick, Paulding & Huber LLP

(57) ABSTRACT

To prevent the sticking of the valve body of an electromagnetic valve under idling conditions or under non-injection conditions in a control device of common rail fuel injection system of an engine wherein the fuel supplied from a feed pump (6) is pressurized to high pressure by a high-pressure pump (3) and the quantity of fuel supply to this high-pressure pump (3) is adjusted by an electromagnetic valve (7) whose degree of opening is controlled in accordance with a duty signal, the control frequency of the duty signal is altered to a lower frequency (λl) when an operating condition such that the degree of opening of the electromagnetic valve (7) is constant is detected. In this way, the energy or amplitude per current wave flowing in the electromagnetic solenoid (39) can be made larger, so making it possible to produce minute vibrations of the valve body (41). Sticking of the valve body (41) can thereby be prevented.

20 Claims, 7 Drawing Sheets

HIGH FREQUENCY

LOW FREQUENCY

ENGINE SPEED
IDLING

TRANSMISSION
NEUTRAL

ACCELERATOR PEDAL
IDLING

CONTROL FREQUENCY
HIGH
Δt
LOW
TIME

| | POWER SOURCE VOLTAGE | | | |
|---|---|---|---|---|
| CONTROL FREQUENCY | 13.5V | 12V | 10V | 8V |
| λh (185Hz) | NG | NG | NG | NG |
| λl (166Hz) | OK | OK | OK | NG |

CONTROL DEVICE OF COMMON RAIL FUEL INJECTION SYSTEM OF AN ENGINE

CROSS REFERENCES TO RELATED APPLICATIONS

This application is entitled to the benefit of and incorporates by reference essential subject matter enclosed in Japanese Patent Application No. 2001-301798 filed Sep. 28, 2001.

BACKGROUND OF THE INVENTION

1. Field of the Invention

The present invention relates to a control device of common rail fuel injection system of an engine chiefly adapted for a diesel engine and in particular relates to a method of controlling an electromagnetic valve that adjusts the quantity or rate of supply of fuel to a high-pressure pump.

2. Description of the Related Art

In a common rail type fuel injection system of an engine, in particular, a diesel engine, high-pressure fuel raised to an injection pressure (from a few tens to a few hundreds of MPa) is accumulated on a common rail and this fuel is injected into the cylinder by opening of an injector valve. Fuel supply to the common rail is effected by intake and discharge of fuel under approximately normal pressure accumulated in a fuel tank by means of a feed pump, followed by supply under pressure of fuel discharged therefrom to the common rail after being pressurized by a high-pressure pump.

An electromagnetic valve whose degree of opening is controlled in accordance with a duty signal is provided between the feed pump and the high-pressure pump and the quantity of supply of fuel to the high-pressure pump is controlled by this electromagnetic valve. That is, when it is desired to raise the common rail pressure comparatively abruptly, the degree of opening of the electromagnetic valve is made large, so that a comparatively large amount of fuel can be supplied to the high-pressure pump. As a result, a comparatively large amount of fuel is supplied under pressure to the common rail by the high-pressure pump, causing the common rail pressure to rise comparatively abruptly. Contrariwise, when it is desired to raise the common rail pressure comparatively slowly, the degree of opening of the electromagnetic valve is made small, so that a comparatively small amount of fuel is supplied to the high-pressure pump. In this way, a comparatively small amount of fuel is supplied under pressure to the high-pressure pump, so the common rail pressure is raised comparatively slowly.

A duty pulse of a prescribed duty ratio is supplied to the electromagnetic solenoid of the electromagnetic valve and the degree of opening of the electromagnetic valve is controlled in accordance with the duty ratio. The duty ratio and the degree of opening of the electromagnetic valve are continuously variable. Microscopically, as shown in FIG. 4, an ON/OFF signal as shown in (a) is repeatedly supplied to the electromagnetic solenoid of the electromagnetic valve. This causes a current of sawtooth shaped waveform as shown in (b) to flow in the electromagnetic solenoid, with the result that the valve body is actuated in response to this current. The mean current value Im changes in accordance with the duty ratio (in this case, the ratio of the ON time tON to the period Th), causing the valve body to be positioned essentially in a position corresponding to this average current value Im and resulting in minute vibrations accompanying the oscillation of the current, referred to this position. A drive current that produces such minute vibrations of the valve body is termed a dither current.

However, there are the following problems with a control device of common rail fuel injection system for a diesel engine mounted in a vehicle. Specifically, in the ordinary running condition etc, the operating state of the vehicle and the engine is continually changing and the target common rail pressure also changes in response thereto. Consequently, the quantity of fuel supply to the high-pressure pump i.e. the degree of opening of the electromagnetic valve, also changes in accordance with the changes of target common rail pressure. The control frequency in duty control of the electromagnetic valve is therefore set to an optimum frequency that is comparatively high so as to be able to track such changes of operating condition.

Conventionally, however, this control frequency was fixed irrespective of the operating condition of the engine and the vehicle. The so-called stick/slip problem was therefore produced of the valve body of the electromagnetic valve becoming stuck if the operating condition was fixed. Specifically, whereas the control frequency was set to a comparatively high frequency taking into account tracking characteristics etc of the operation of the electromagnetic valve in the high-speed range, if this was done, sticking of the valve body occurred during idling (when the valve body of the electromagnetic valve is fixed with a slight degree of opening) and/or during non-injection condition (fuel cut-off), as in the case of engine braking (when the valve body of the electromagnetic valve is fixed in the fully closed position). This is because, while frictional force due to viscosity of the fuel and/or friction constantly acts on the valve body sliding section, as shown in FIG. 4(*b*), at high frequencies the energy per current wave or the amplitude Ih are comparatively small, and are therefore insufficient to create minute vibrations of the valve body.

When such sticking of the valve body occurs, in order to subsequently move the valve body, it must be driven to overcome the force of static friction. Controllability is therefore adversely affected in that the valve body cannot perform tracking movement in the event of change of operating condition from fixed operating condition.

Also, in recent years, desulfurization of fuel (light oil) is carried out as a counter-measure against particulate material (PM); if this is done, the coefficient of friction of the fuel may become about twice that which is obtained conventionally, so the probability of sticking is further increased.

SUMMARY OF THE INVENTION

The present invention was made in view of the above problems, its object being to provide a control device of common rail fuel injection system of an engine wherein sticking of the valve body of the electromagnetic valve under idling conditions or under non-injection conditions can be prevented.

According to the present invention there is provided a control device of common rail fuel injection system of an engine comprising: a high-pressure pump that pressurizes to a high pressure fuel supplied from a feed pump; an electromagnetic valve for adjusting the quantity of fuel supply to the high-pressure pump located on a passage between this feed pump and high-pressure pump; and electromagnetic valve control means that controls the degree of opening of this electromagnetic valve in accordance with a duty signal, further comprising: detection means that detects an operating condition of the control device such that the degree of opening of said electromagnetic valve is constant and control frequency alteration means that alters the control frequency of said duty signal to a lower frequency when such an operating condition is detected.

With the present invention, since the control frequency of the duty signal is altered to lower frequency under a condition such that the degree of opening of the electromagnetic valve is constant, the energy or amplitude per current wave flowing in the electromagnetic solenoid can be made larger, thereby enabling minute vibrations of the valve body to be produced. In this way the valve body can be prevented from sticking.

The operating condition in which the degree of electromagnetic valve opening is constant may be idling condition or non-injection condition of the engine.

The control device may be for the engine for a vehicle and the detection means may identify the operating condition that the degree of opening of said electromagnetic valve is constant when the engine speed is the idling speed, the transmission is in neutral position and the accelerator pedal is in the fully closed position.

Also the control device may be for the engine for a vehicle and the detection means may identify the operating condition that the degree of opening of said electromagnetic valve is constant when the engine speed is higher than the idling speed, the transmission is shifted in any gear position and the target fuel-injection quantity to the engine is zero.

Also, when the control frequency of the duty signal is altered to lower frequency, the control frequency alteration means may correct the duty ratio of the duty signal such that the average value of the current flowing in the electromagnetic solenoid of the electromagnetic valve is the same as if the control frequency were not altered.

Also the electromagnetic valve may comprise an electromagnetic solenoid that is supplied with the duty signal, a spool-shaped valve body that is actuated in response to current flowing in this electromagnetic solenoid and a spring that biases this valve body in the opening direction.

Also the control frequency of said duty signal may be normally at least 170 Hz and less than 190 Hz but at least 120 Hz and less than 170 Hz when altered by the control frequency alteration means.

Also according to the present invention an electromagnetic valve control method for a control device of common rail fuel injection system of an engine wherein fuel supplied from a feed pump is pressurized to high pressure by a high-pressure pump and the quantity of fuel supply to this high pressure pump is adjusted by an electromagnetic valve whose degree of opening is controlled in accordance with a duty signal comprises a step of detecting an operating condition in which the degree of opening of said electromagnetic valve is constant and a step of, when such an operating condition is detected, altering the control frequency of said duty signal to a lower frequency.

Also according to the present invention an electromagnetic valve control device for a fluid circuit comprising an electromagnetic valve for adjusting the amount of working fluid and electromagnetic valve control means that controls the degree of opening of this electromagnetic valve in accordance with a duty signal, comprises: detection means that detects an operating condition in which the degree of opening of said electromagnetic valve is constant and control frequency alteration means that alters the control frequency of said duty signal to a lower frequency when such an operating condition is detected.

DESCRIPTION OF THE PREFERRED EMBODIMENTS

Preferred embodiments of the present invention are described below with reference to the accompanying drawings.

Figure 3:
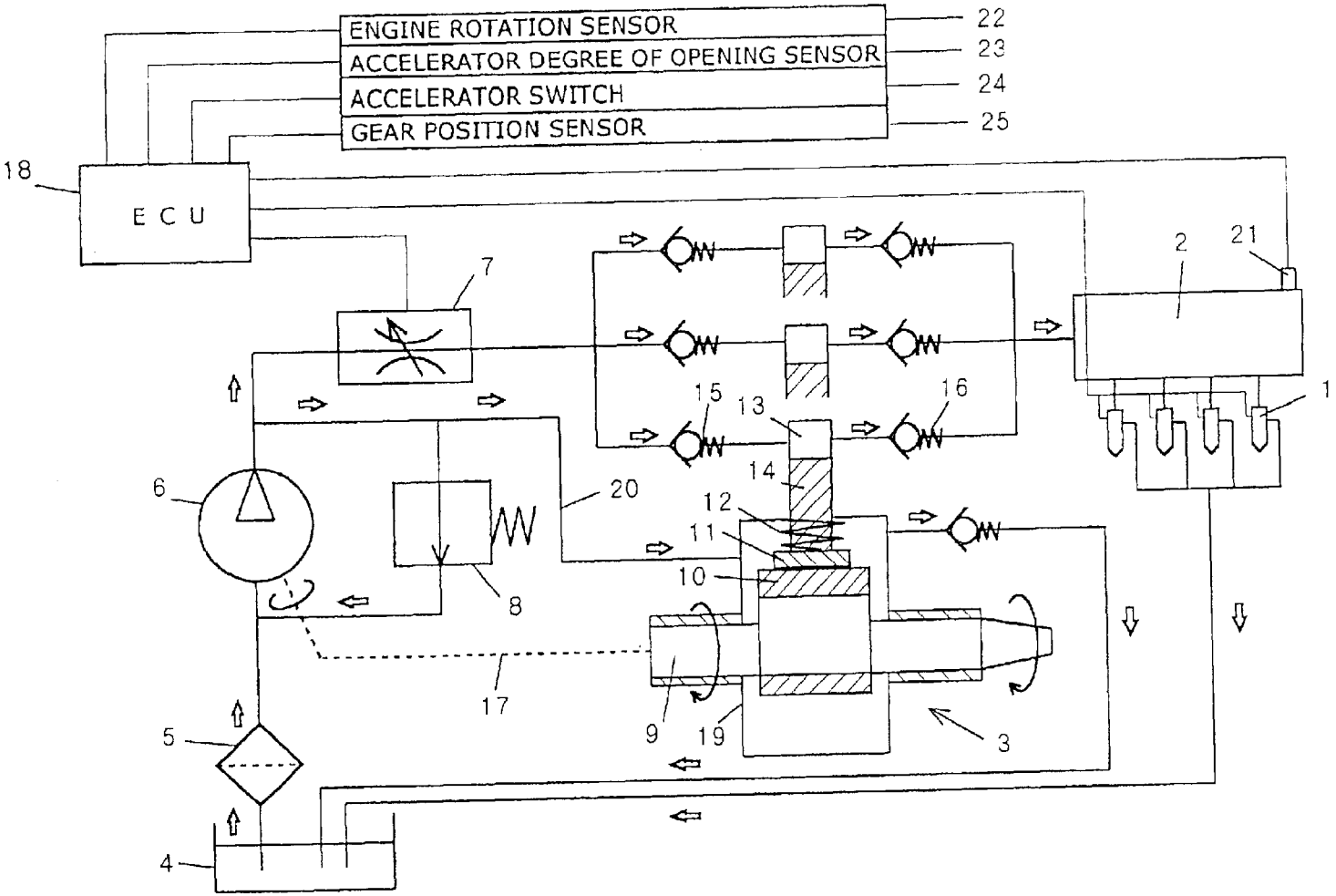
FIG. 3 is a system diagram of a control device of common rail fuel injection system of an engine according to this embodiment.

FIG. 3 illustrates the overall layout of a control device of common rail fuel injection system of an engine according to this embodiment. This device is for performing fuel injection control of an engine (not shown), a diesel engine in the case of this embodiment, mounted on a vehicle.

Injectors 1 are provided for each cylinder of the engine and high-pressure fuel of common rail pressure accumulated on common rail 2 (from a few tens to a few hundreds of MPa) is constantly supplied to each of these injectors 1. Pressurized supply of fuel to common rail 2 is performed by a high-pressure pump (supply pump) 3. Specifically, fuel (light oil) of about normal pressure from fuel tank 4 is sucked by feed pump 6 through fuel filter 5 and is furthermore fed to high-pressure pump 3 from feed pump 6 and pressurized by high-pressure pump 3, before being supplied under pressure to common rail 2.

Between feed pump 6 and high-pressure pump 3, there is located on a passage a metering valve 7 for adjusting the quantity of supply of fuel to high-pressure pump 3. Metering valve 7 is an electromagnetic valve, as will be described. Also, a relief valve 8 is provided in parallel with feed pump 6 for adjusting the outlet pressure of feed pump 6.

High-pressure pump 3 is chiefly constituted by a pump shaft 9 that is synchronously driven by the engine, a cam ring 10 that is fitted at the periphery of pump shaft 9, a tappet 11 that is sidably mounted at the periphery of cam ring 10, a pressure spring 12 that presses tappet 11 against cam ring 10, a plunger 14 that pressurizes the fuel of plunger chamber 13 by lifting simultaneously when tappet 11 is lifted by cam ring 10 and check valves 15, 16 that are provided at the inlet and outlet of plunger chamber 13.

Tappet 11, pressure spring 12, plunger chamber 13, plunger 14 and check valves 15, 16 constitute a pressurized supply section; this pressurized supply section is divided into three at intervals of 120° at the periphery of pump shaft 9. Pressurized fuel supply is thereby performed three times per pump revolution of high-pressure pump 3. In the Figure, for convenience, the three pressurized supply sections are shown in planar fashion.

The pump shaft 9 of high-pressure pump 3 and the pump shaft (not shown) of feed pump 6 are linked to the engine by mechanical linkage means 17 such as a chain mechanism, belt mechanism or gear mechanism and high-pressure pump 3 and feed pump 6 are thereby synchronously driven with the engine.

The flow of fuel in this device is as shown by the arrows in the Figure. Specifically, the fuel of fuel tank 4 is delivered to feed pump 6 after passing through fuel filter 5 and is furthermore fed to metering valve 7. The output pressure from feed pump 6 is adjusted by relief valve 8 and the excess fuel passing through relief valve 8 is returned to the inlet side of feed pump 6. The degree of opening of metering valve 7 is controlled by an electronic control unit (hereinbelow referred to as an ECU) 18, so that an amount of fuel corresponding to this degree of opening is delivered from metering valve 7.

In addition, this fuel that has been thus delivered is introduced into plunger chamber 13 by pressing open inlet side check valve 15. It is then pressurized to high pressure by the lift of plunger 14 and when its pressure has risen to such an extent as to exceed the valve opening pressure of outlet side check valve 16 presses open outlet side check valve 16 and is introduced onto common rail 2. The common rail pressure is thereby raised by an amount matching the amount of fuel delivered from the metering valve 7. The fuel of common rail 2 is constantly supplied to injectors 1 and when injectors 1 are opened the fuel of common rail 2 is injected into the cylinders.

It should be noted that fuel leakage discharged from injectors 1 with opening/closing control of injectors 1 is directly returned to fuel tank 4. Also, fuel on the outlet side of feed pump 6 is introduced into casing 19 of high-pressure pump 3 through conduit 20 so as to lubricate the sliding parts in high-pressure pump 3 with fuel.

ECU 18 performs overall electronic control of this device and chiefly performs opening/closing control of injectors 1 in accordance with the operating condition of the engine and vehicle (for example the engine rotational speed, engine load etc, hereinbelow referred to as "operating condition of the engine etc"). Fuel injection is performed/stopped in accordance with ON/OFF of the electromagnetic solenoids of injectors 1.

Also, ECU 18 controls the degree of opening of metering valve 7 and the common rail pressure in accordance with the operating condition of the engine etc. The actual common rail pressure is detected by common rail pressure sensor 21 and an optimum target common rail pressure is set from the operating condition of the engine etc; the actual common rail pressure is subjected to feedback control so that it always approaches this target common rail pressure.

The degree of opening of metering valve 7 is controlled in accordance with the difference of the target common rail pressure and the actual common rail pressure being for example controlled to a large degree of opening in order to increase the amount fed under pressure from the high-pressure pump if the actual common rail pressure is comparatively much less than the target common rail pressure.

Various types of sensors are provided for detecting the operating condition of the engine etc. These include an engine rotational speed sensor 22 that detects the rotational speed (number of revolutions) of the engine, accelerator degree of opening sensor 23 for detecting the degree of opening of the accelerator (amount of depression of the accelerator pedal), accelerator switch 24 for detecting whether or not the degree of opening of the accelerator is 0 (whether or not the accelerator pedal is depressed) and gear position sensor 25 for detecting the gear position of the transmission (including neutral). The sensors are electrically connected with ECU 18.

The method of controlling metering valve 7 will now be described in detail. The degree of opening of this metering valve 7 is controlled in accordance with a duty signal that is transmitted from ECU 18.

Figure 1:
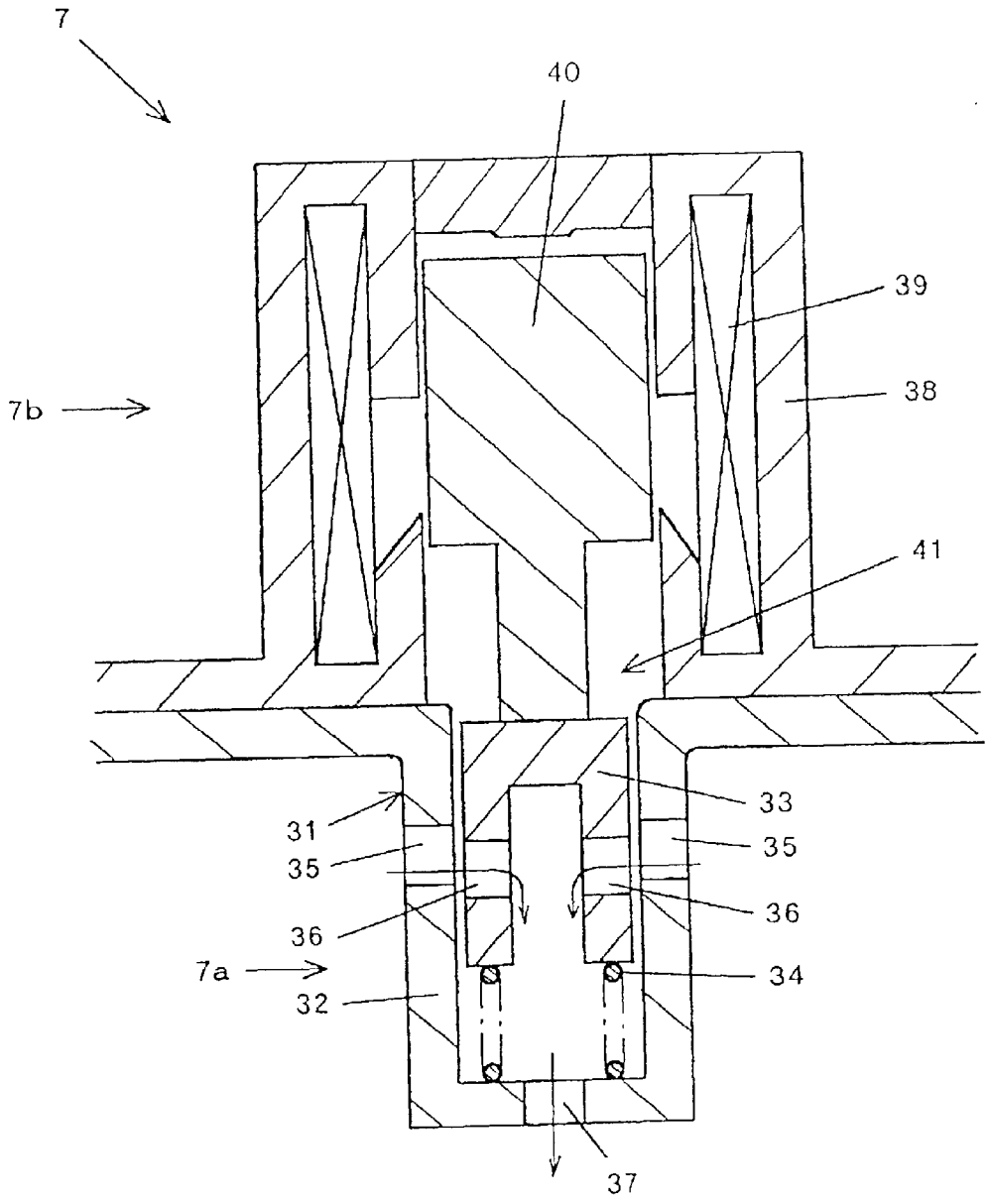
FIG. 1 is an axial cross sectional view of a metering valve.

First of all, the construction of metering valve 7 will be described using FIG. 1. Metering valve 7 chiefly comprises a metering section 7*a* shown in the lower part of the Figure and an actuator section 7*b* shown in the upper part of the Figure and is arranged as a normally open electromagnetic valve. In metering section 7*a*, a valve piece 33 and return spring 34 are accommodated within a cylindrical section 32 of a casing 31; the quantity of introduction of fuel arriving at inlet port 35 from feed pump 6 is arranged to be varied by varying the passage area in the connecting section of the inlet port 35 provided in the side wall of cylindrical section 32 and an introduction port 36 provided in valve piece 33 by vertical sliding movement of valve piece 33 within cylinder section 32. Valve piece 33 is a cylindrical member blocked at the top that feeds fuel introduced from introduction port 36 downwards. Return spring 34 is gripped in a compressed condition between the bottom end face of valve piece 33 and the bottom wall of cylindrical section 32, and biases valve piece 33 upwards i.e. in the opening direction. Fuel introduced from introduction port 36 is discharged to high-pressure pump 3 from outlet port 37 provided in the bottom wall of cylindrical section 32.

In actuator section 7*b*, an electromagnetic solenoid 39 is embedded in a cylindrical yoke 38 fixed at the top of casing 31 and an armature 40 is vertically slidably arranged in the hollow section in the middle of yoke 38. Armature 40 is surrounded from its outer circumferential side by electromagnetic solenoid 39 so that when current is passed through electromagnetic solenoid 39 armature 40 is driven downwards i.e. in the valve-closing direction. Armature 40 and valve piece 33 are normally united by the bottom end face of armature 40 and the top end face of valve piece 33 tightly adhering due to the biasing force produced by return spring 34 and the electromagnetic force produced by electromagnetic solenoid 39. These therefore act as a unified valve body 41. This valve body 41 is formed in spool shape as shown in the drawing and slides while being immersed in the fuel with which casing 31 and the interior of yoke 38 is filled. Return spring 34 corresponds to the spring of the present invention.

Figure 4A:
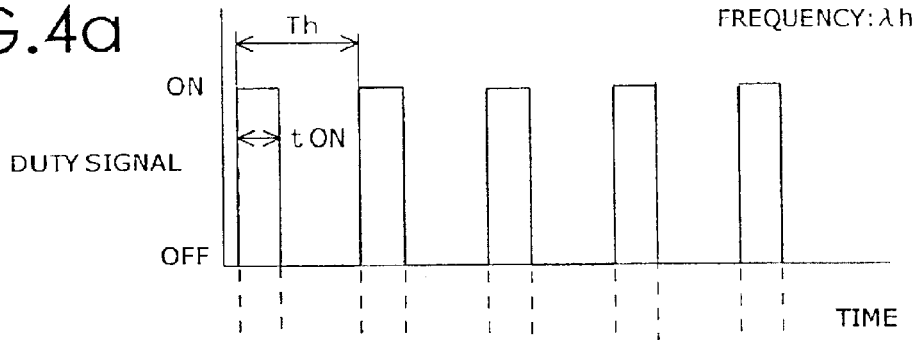
FIGS. 4*a* and 4*b* are views illustrating the details of high frequency control of the metering valve.

The degree of opening of metering valve 7 is controlled by delivery of a duty signal (duty pulse) as shown in FIG. 4*a* to electromagnetic solenoid 39 from ECU 18. The "degree of opening" of metering valve 7 indicates the passage area in the connection portion of inlet port 35 and introduction port 36. ECU 18 is provided with a known PWM circuit whose output is supplied to electromagnetic solenoid 39.

Figure 4B:
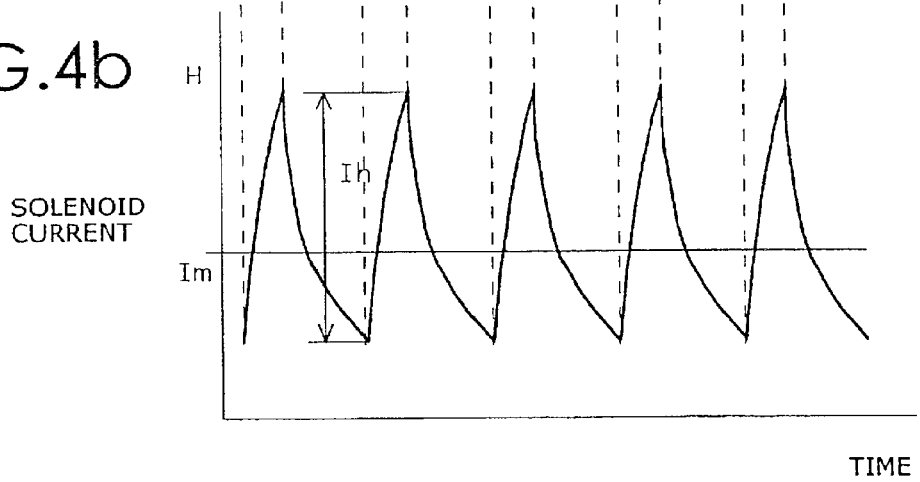

FIG. 4*a* and FIG. 4*b* show control under ordinary conditions; the period of the duty signal is then Th and its frequency is $\lambda h$ (=1/Th). In this way, the electromagnetic solenoid 39 and metering valve 7 are controlled to a comparatively small period Th in each case (for example 20 msec in each case). The duty ratio is determined in accordance with the difference between the target common rail pressure and the actual common rail pressure (in this case, the ratio of the ON time tON per period i.e. the ON duty ratio); the duty ratio is set to progressively smaller values as this difference becomes larger i.e. as a larger quantity of pressurized supply is demanded from high-pressure pump 3. In particular λh is set to a comparatively high frequency so as to enable tracking of large changes of the operating condition of the engine etc and with actuation tracking performance of metering valve 7 in the high-speed region in view.

When an ON/OFF repeated signal as shown in FIG. 4*a* is applied to electromagnetic solenoid 39, in response to this, rising-edge current and trailing-edge current flow alternately in electromagnetic solenoid 39 as shown in FIG. 4*b*, producing a current of sawtooth shaped waveform of average value Im. Valve body 41 is actuated in response to this solenoid current and essentially is thereby positioned at a position corresponding to the average value Im, performing minute vibrations about this position.

Figures 2A, 2B, 2C:
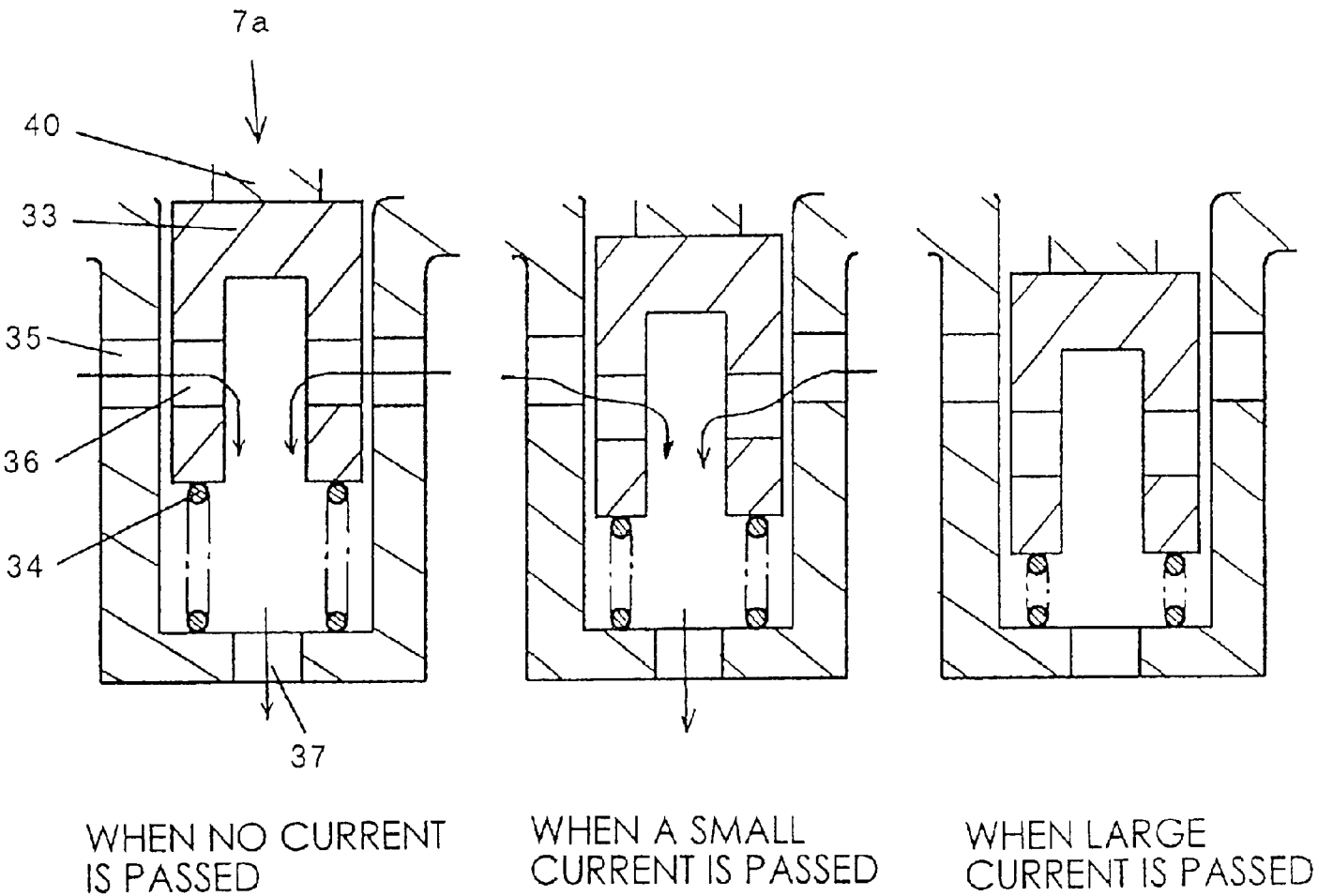
FIGS. 2*a*, 2*b* and 2*c* are axial cross-sectional views illustrating the actuated condition of the metering valve.

FIG. 2*a* and FIG. 2*b* show the various conditions of metering section 7*a* of metering valve 7. FIG. 2*a* shows the condition when no current is passed through the electromagnetic solenoid; under these conditions, inlet port 35 and introduction port 36 are completely in communication and the degree of valve opening is a maximum (fully open). A maximum flow rate is then supplied to high-pressure pump 3, causing pressurized fuel to be delivered at a maximum quantity from high-pressure pump 3. FIG. 2*b* shows the small-current condition; in this condition, inlet port 35 and introduction port 36 are only partially in communication and the degree of valve opening is an intermediate degree of valve opening. Pressurized fuel is then delivered at an intermediate quantity from high-pressure pump 3. FIG. 2*c* shows the large-current condition; in this condition, inlet port 35 and introduction port 36 are not in communication and the degree of opening of the valve is a minimum (fully closed). No fuel is then supplied to high-pressure pump 3 and no pressurized fuel is therefore delivered from high-pressure pump 3. In this way, the degree of opening of metering valve 7 can be continuously varied from fully open to fully closed by controlling the average current value flowing in the electromagnetic solenoid by changing the duty ratio.

However, if the operating condition of the engine etc is fixed, there is the possibility of occurrence of sticking (so-called stick/slip) of valve body 41, as described above. Specifically, in the idling condition, there is essentially no change of operating condition, so the valve body 41 of metering valve 7 is constantly fixed in a position with a slight degree of opening, so that a very small quantity of fuel continues to be supplied to high-pressure pump 3. Also, in the non-injection (fuel cut-off) condition during engine braking, valve body 41 of metering valve 7 is fixed in a completely closed position, so that a condition continues in which no supply of fuel is performed to high-pressure pump 3.

In such cases, the degree of opening of the valve is maintained fixed, so valve body 41 is fixed in a constant position. Under these conditions, it would be expected that valve body 41 should still vibrate slightly due to the current of waveform shown in FIG. 4*b*, but, since the control frequency λh is high, the amplitude Ih of the current is itself small. Sufficient energy cannot therefore be supplied to produce minute vibrations of valve body 41 and valve body 41 consequently becomes stuck. In other words, since the energy per wave of the current is small and frictional force is present due to the viscous resistance and/or coefficient of friction of the fuel on the sliding section of valve body 41, valve body 41 cannot achieve minute vibrations and sticking of valve body 41 occurs. This tendency to stick is even more pronounced in particular if fuel of higher coefficient of friction than conventionally, which has been desulfurized as a counter-measure against particulate materials (PM) is employed.

If the valve body gets into this stuck condition, even though valve body 41 subsequently tries to move in the opening direction in response to change of operating condition, since the static frictional force that acts on valve body 41 is larger than the dynamic frictional force, the drive energy of valve body 41 (provided by return spring 34) cannot overcome the static frictional force, with the result that there is a possibility of inconveniences occurring such as momentary delay in actuation of valve body 41. The static frictional force is larger in particular if fuel of high coefficient of friction is employed, resulting, in the worst case, in valve body 41 becoming incapable of actuation. It may be noted that, while the method is available of applying high power (voltage) instantaneously in order to create a trigger for the initial actuation of the valve, if this is done, there are the inconveniences that the average current becomes high, resulting in a change in the degree of valve opening or a sudden lurching movement at some time point, so this method cannot be adopted.

Accordingly, in order to eliminate this problem, in this device, the method was adopted of altering the control frequency of the duty signal to lower frequency if the degree of opening of metering valve 7 has become constant.

Figures 5A, 5B:
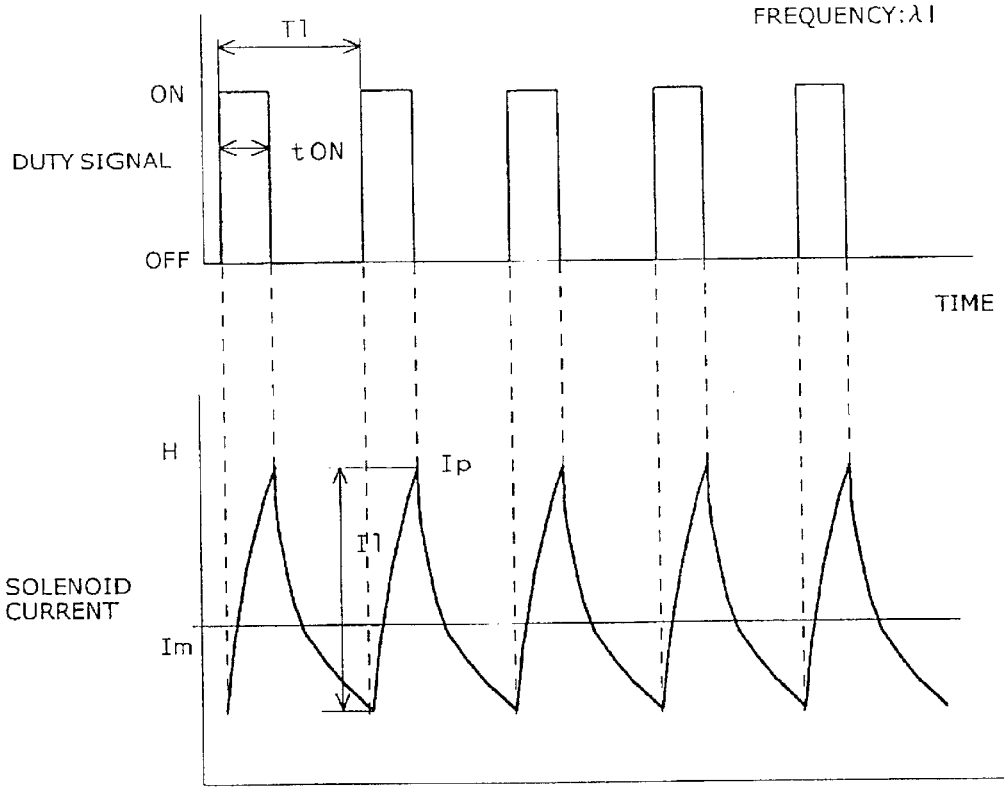
FIGS. 5*a* and 5*b* are views illustrating the details of low frequency control of the metering valve.

This shown in FIG. 5; the period of the duty signal is altered to T1 (>Th) and the frequency is altered to λl (<λh). As can be seen by comparison with FIG. 4*a* and FIG. 4*b*, even for the same duty ratio, when the control frequency is made lower, the ON time tON becomes longer, and the amplitude I1 and peak value Ip of the current become larger, so a larger drive energy can be applied to valve body 41. That is, the energy per wave of the current becomes large, making it possible to cause the valve body 41 to constantly execute minute vibrations without becoming stationary (getting stuck). Also, even if it should become stationary, since drive force can be applied that is able to overcome the static frictional force, minute vibrations can be initiated. The average current value is the same Im and the reference position of valve body 41 is unchanged. Valve body 41 is therefore made to execute minute vibrations while maintaining the same degree of valve opening, but can be prevented from getting stuck. Thus, since valve body 41 is vibrating, the frictional force acting on valve body 41 becomes the dynamic frictional force, which is smaller than the static frictional force, so when it is subsequently attempted to move the valve body 41, this can be achieved without actuation lag.

In this way, with this device, actuation tracking performance under high-speed operation can be ensured by means of a high control frequency λh while, during idling operation etc, stability of control can be ensured by a low control frequency λl.

It should be noted that, if the control frequency is altered from high frequency to low frequency while keeping the duty ratio constant there may be some change in degree of valve opening due to slight change in the average current value. In such cases, it is preferable to correct the duty ratio such that the same average current value is obtained. If this is done, the degree of valve opening can be kept constant. Such methods of correction that may be considered involve for example PI control with feedback of the current value.

If the control frequency is changed over to the low frequency side during non-injection conditions, valve body 41 oscillates vertically about the reference position while maintaining the fully closed position as shown in FIG. 2*c*. Return spring 34 is then not fully compressed so as to leave some margin in respect of the extension/retraction stroke. This is because, if return spring 34 is fully compressed, it abuts valve body 41 so the original oscillation amplitude cannot be maintained.

However, in this embodiment, the control frequency is only changed to the low frequency side during idling and under non-ignition conditions during engine braking. The reason for this is that, apart from these conditions, the operating condition of the engine etc is continually changing, so that change of the degree of valve opening can be expected. For example in a cruising condition with fixed engine speed and gear ratio, even if the apparent operating condition is unchanged, due to the effect of external disturbances such as changes of road surface condition, the engine operating condition is in fact always changing so the valve degree of opening also changes slightly. Consequently, since the degree of valve opening is not constant as was described above, it appears unnecessary to alter the control frequency.

Of course, if there are cases other than the above where the degree of valve opening becomes constant, it would be desirable to alter the frequency on each such occasion. For example, a two-dimensional or multi-dimensional changeover map can be created beforehand in accordance with engine speed and/or load etc and the control frequency changed over in accordance with this map. Also, the frequency is not restricted to being set at two levels, namely, high and low but could be set at multiple levels.

Next, the conditions for alteration of the control frequency will be described. First of all, the idling condition is as shown in FIGS. 6*a* to 6*d*. Specifically, if the three conditions: engine speed is idling speed (FIG. 6*a*), transmission is in neutral (FIG. 6*b*), and accelerator pedal is in the idling position i.e. fully returned (FIG. 6*c*) are established, the control frequency is immediately altered from high-frequency λh to low frequency λl. The accelerator pedal condition can be determined using one or both of the case that accelerator degree of opening zero is detected by accelerator degree of opening sensor 23 and the case that the accelerator switch 24 has become ON (or OFF). If any of these three conditions is no longer established, the control frequency is immediately changed to high control frequency λh.

As will be understood from the above three conditions, the idling condition as referred to herein includes not merely the ordinary case where the vehicle is idling while stationary but also the cases where the vehicle is moving slowly/decelerating with the accelerator and gear disengaged. The condition that the vehicle speed is zero could be added to the above three conditions; in this case the idling condition indicates exclusively ordinary idling while the vehicle is stationary.

Furthermore, although not shown in the drawing, in the non-injection condition during engine braking, where the three conditions: engine speed higher than idling speed, some gear ratio selected by the transmission, and target fuel injection quantity of zero are established, the control frequency is altered from the high control frequency λh to the low control frequency λl. This condition "target fuel-injection quantity zero" is evaluated by ECU 18 from its own internal data. If any of these three conditions ceases to be established, the control frequency is immediately changed to high frequency λh.

Figures 6A, 6B, 6C, 6D:
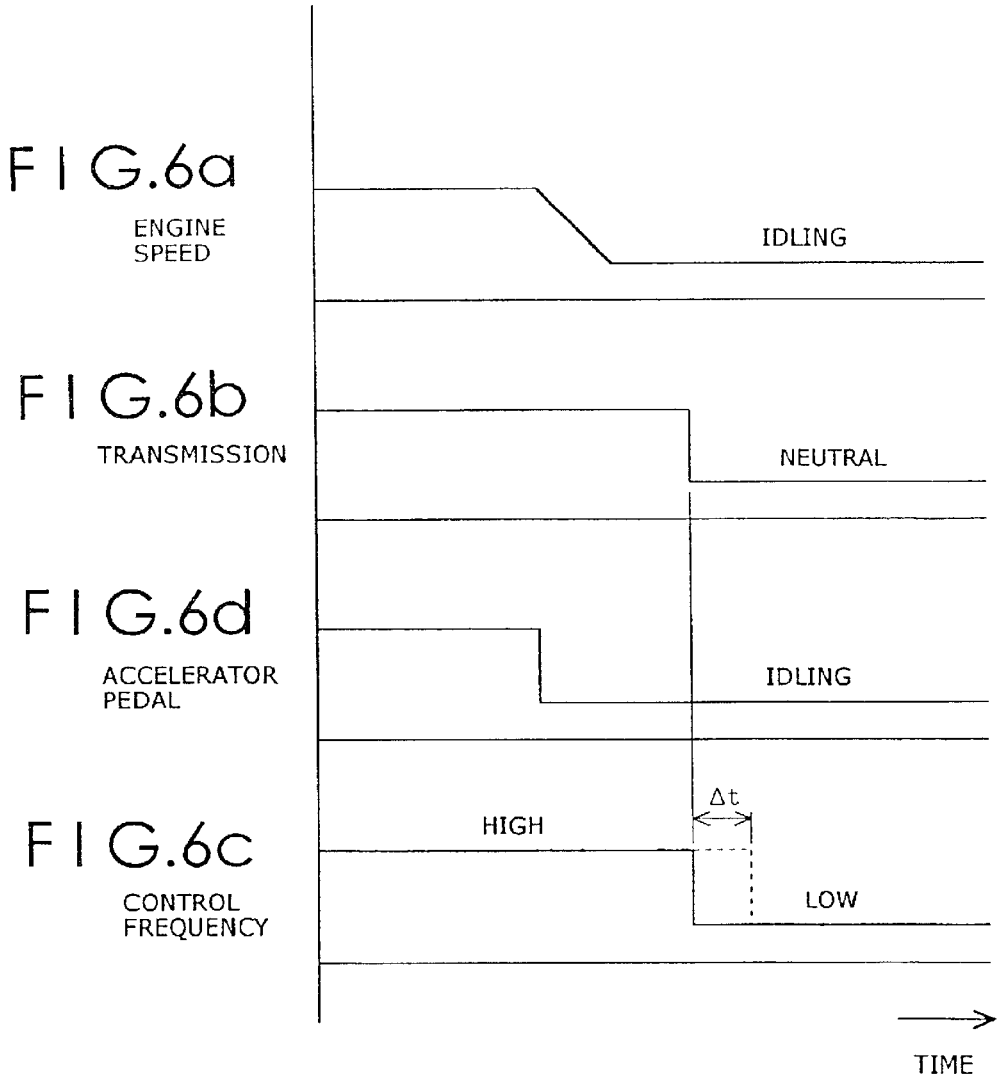
FIGS. 6*a*, 6*b*, 6*c* and 6*d* are time charts illustrating frequency alteration conditions.

Both in the case of the idling condition and the non-injection condition, a waiting time (delay time) Δt may be provided as shown by the broken line in FIG. 6*d*. Specifically, in this method, the frequency is changed after lapse of Δt from the time where all of the conditions are established. This is advantageous in regard to control stability in that the frequency change will not be executed even if the conditions are momentarily established. Δt is for example 0.2 s.

Figures 7, 8:
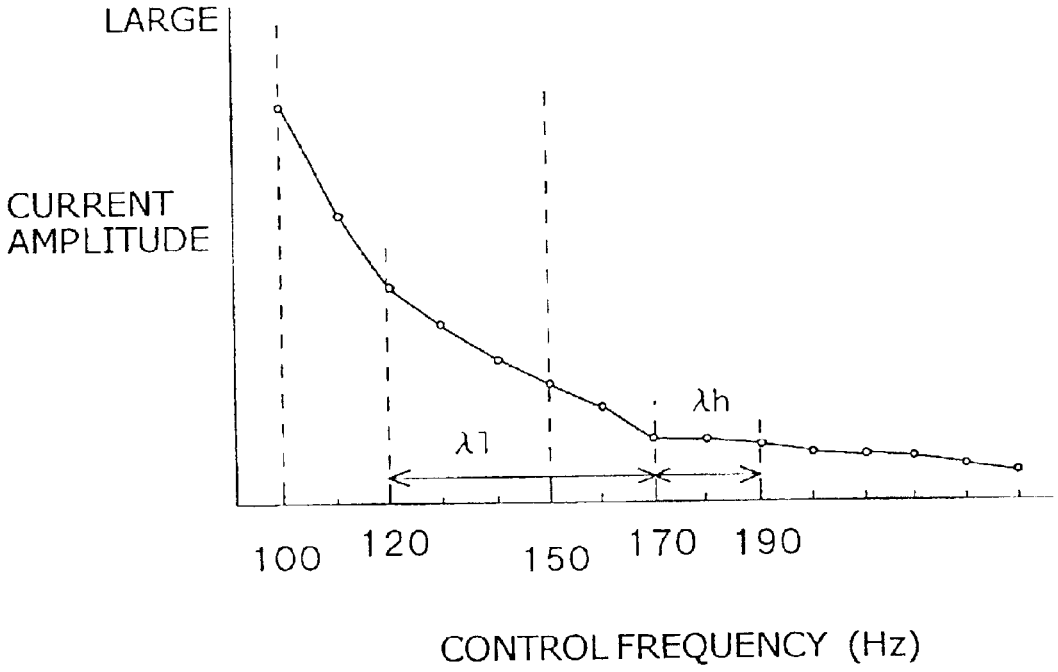
FIG. 7 is a graph illustrating the relationship between control frequency and current amplitude in the electromagnetic solenoid of the metering valve.
FIG. 8 shows the results of experiments to determine the ability to withstand the influence of power source voltage at each control frequency.

In this embodiment, as shown in FIG. 7, the control frequency λh on the high frequency side is normally set to a value in the range 170 Hz≦λh≦190 Hz, for example 185 Hz. Also, the control frequency λl on the low frequency side is normally set to a value in the range 120 Hz≦λl≦170 Hz, for example 166 Hz. This is because of the difference in characteristics in that, if the control frequency is more than 170 Hz, the current amplitude shows scarcely any change with respect to variation in frequency but if the control frequency is less than 170 Hz larger current amplitude is obtained as the frequency is decreased.

According to actual experiments, as shown in FIG. 8, it has been found that ability to withstand the influence of power source voltage is higher when the control frequency is lower. Specifically, this Figure is an example of comparison of the cases where λh=185 Hz and λl=166 Hz, showing the results of ascertaining whether or not sticking of the valve body occurred at each power source voltage. NG means that sticking occurred and OK means that sticking did not occur. As shown in the Figure, under idling conditions, sticking occurred at all power source voltages when λh=185 Hz but when λl=166 Hz sticking only occurred at 8 V; no sticking occurred at 10 V, 12 V or 13.5 V. This means that, as mentioned above, the ability to withstand drop of power source voltage is greater as the energy per current wave becomes larger. It was thus confirmed that with lower frequencies it is more easily possible to withstand the effects of external disturbances, namely, drop of power source voltage.

As will be clear from the above description, in this embodiment, ECU 18 acts as the electromagnetic valve control means, detection means and control frequency alteration means of the present invention.

Apart from the above embodiment of the present invention various other embodiments may be envisaged. For example, in the above embodiment, the frequency was altered by detecting the idling condition or non-injection condition from the output of an engine speed sensor 22 or the like; however, it would be possible to alter the frequency by directly detecting the solenoid current values corresponding to these. Also, although, in the above embodiment the electromagnetic valve was a spool-type normally-open electromagnetic valve, it could be a rotary-type normally-closed electromagnetic valve. Also, although, in the above embodiment, a diesel engine mounted on a vehicle was taken as an example, this could be applied to a wide range of industrial engines for driving power generators etc. This is because industrial engines are generally frequently operated at fixed speed and load for long periods so cases where the degree of valve opening is constant may be assumed to be common.

Furthermore, this electromagnetic valve control device and control method are applicable not merely to metering valves of control device of common rail fuel injection system of an engine but to all electromagnetic valves of fluid circuits, which may use a working fluid other than fuel. That is, the same beneficial effect is obtained by performing electromagnetic valve control as described above so long as the degree of valve opening is fixed under certain specified operating conditions.

As summarized above, with the present invention, the considerable benefit is obtained that sticking of the valve body of the electromagnetic valve under idling conditions or under non-injection conditions can be prevented.

What is claimed is:

1. A control device of common rail fuel injection system of an engine comprising: a high-pressure pump that pressurizes to a high pressure fuel supplied from a feed pump; an electromagnetic valve which is located on a passage between this feed pump and high-pressure pump in order to adjust the quantity of fuel supply to the high-pressure pump; and electromagnetic valve control means for controlling the degree of opening of this electromagnetic valve in accordance with a duty signal, said device further comprising: detection means for detecting an operating condition of the control device such that the degree of opening of said electromagnetic valve is constant; and control frequency alteration means for altering the control frequency of said duty signal to a lower frequency when such an operating condition is detected;

wherein said operating condition in which the degree of electromagnetic valve opening is constant in idling condition or non-injection condition of the engine.

2. The control device according to claim 1 for the engine for a vehicle, wherein said detection means identifies said operating condition in which the degree of opening of the electromagnetic valve is constant when the engine speed is in idling speed region, the transmission is in neutral position and the accelerator pedal is in a fully closed position.

3. The control device according to claim 1 for the engine for a vehicle wherein said detection means identifies said operating condition in which the degree of opening of the electromagnetic valve is constant when the engine speed is higher than the idling speed, the transmission is shifted in any gear position and the target fuel-injection quantity to the engine is zero.

4. The control according to claim 1 wherein, when the control frequency of said duty signal is altered to lower frequency, said control frequency alteration means corrects the duty ratio of said duty signal such that the average value of the current flowing in the electromagnetic solenoid of said electromagnetic valve is the same as if said control frequency had not been altered.

5. The control device according to claim 1, wherein said electromagnetic valve comprises an electromagnetic solenoid that is supplied with said duty signal, a spool-shaped valve body that is actuated in response to current flowing in this electromagnetic solenoid, and a spring that biases this valve body in the opening direction.

6. The control device according to claim 1 wherein the control frequency of said duty signal is normally no less than 170 Hz and no greater than 190 Hz, but is at least 120 Hz and less than 170 Hz when altered by said control frequency alteration means.

7. An electromagnetic valve control method for a control device of common rail fuel injection system of an engine wherein fuel supplied from a feed pump is pressurized to high pressure by a high-pressure pump and the quantity of fuel supply to this high pressure pump is adjusted by an electromagnetic valve whose degree of opening is controlled in accordance with a duty signal, comprising the steps of: detecting an operating condition in which the degree of opening of said electromagnetic valve is constant; and when such an operating condition is detected, altering the control frequency of said duty signal to a lower frequency.

8. An electromagnetic valve control device for a fluid circuit comprising an electromagnetic valve for adjusting the amount of working fluid and electromagnetic valve control means for controlling the degree of opening of this electromagnetic valve in accordance with a duty signal, said electromagnetic valve control device comprising: detection means for detecting an operating condition in which the degree of opening of said electromagnetic valve is constant; and control frequency alteration means for altering the control frequency of said duty signal to a lower frequency when such an operating condition is detected.

9. The control according to claim 1 wherein, when the control frequency of said duty signal is altered to lower frequency, said control frequency alteration means corrects the duty ratio of said duty signal such that the average value of the current flowing in the electromagnetic solenoid of said electromagnetic valve is the same as if said control frequency had not been altered.

10. The control according to claim 2 wherein, when the control frequency of said duty signal is altered to lower frequency, said control frequency alteration means corrects the duty ratio of said duty signal such that the average value of the current flowing in the electromagnetic solenoid of said electromagnetic valve is the same as if said control frequency had not been altered.

11. The control according to claim 3 wherein, when the control frequency of said duty signal is altered to lower frequency, said control frequency alteration means corrects the duty ratio of said duty signal such that the average value of the current flowing in the electromagnetic solenoid of said electromagnetic valve is the same as if said control frequency had not been altered.

12. The control device according to claim 1, wherein said electromagnetic valve comprises an electromagnetic solenoid that is supplied with said duty signal, a spool-shaped valve body that is actuated in response to current flowing in this electromagnetic solenoid, and a spring that biases this valve body in the opening direction.

13. The control device according to claim 2, wherein said electromagnetic valve comprises an electromagnetic solenoid that is supplied with said duty signal, a spool-shaped valve body that is actuated in response to current flowing in this electromagnetic solenoid, and a spring that biases this valve body in the opening direction.

14. The control device according to claim 3, wherein said electromagnetic valve comprises an electromagnetic solenoid that is supplied with said duty signal, a spool-shaped valve body that is actuated in response to current flowing in this electromagnetic solenoid, and a spring that biases this valve body in the opening direction.

15. The control device according to claim 4, wherein said electromagnetic valve comprises an electromagnetic solenoid that is supplied with said duty signal, a spool-shaped valve body that is actuated in response to current flowing in this electromagnetic solenoid, and a spring that biases this valve body in the opening direction.

16. The control device according to claim 1 wherein the control frequency of said duty signal is normally no less than 170 Hz and no greater than 190 Hz, but is at least 120 Hz and less than 170 Hz when altered by said control frequency alteration means.

17. The control device according to claim 2 wherein the control frequency of said duty signal is normally no Less than 170 Hz and no greater than 190 Hz, but is at least 120 Hz and less than 170 Hz when altered by said control frequency alteration means.

18. The control device according to claim 3 wherein the control frequency of said duty signal is normally no less than 170 Hz and no greater than 190 Hz, but is at least 120 Hz and less than 170 Hz when altered by said control frequency alteration means.

19. The control device according to claim 4 wherein the control frequency of said duty signal is normally no less than 170 Hz and no greater than 190 Hz, but is at least 120 Hz and less than 170 Hz when altered by said control frequency alteration means.

20. The control device according to claim 5 wherein the control frequency of said duty signal is normally no less than 170 Hz and no greater than 190 Hz, but is at least 120 Hz and less than 170 Hz when altered by said control frequency alteration means.

* * * * *